US005404286A

United States Patent [19]

Boutges

[11] Patent Number: 5,404,286

[45] Date of Patent: Apr. 4, 1995

[54] LAMP SHADE ADAPTER

[76] Inventor: Claude M. J. Boutges, 10 Mitchell Rd., Westhampton Beach, N.Y. 11978

[21] Appl. No.: 120,569

[22] Filed: Sep. 13, 1993

[51] Int. Cl.[6] ..... F21S 1/12

[52] U.S. Cl. ..... 362/410; 362/414; 362/457; 437/641

[58] Field of Search ..... 362/410, 414, 433, 442, 362/457; 439/641, 642, 643, 227, 228, 234; 403/299

[56] References Cited

U.S. PATENT DOCUMENTS

| | | | |
|---|---|---|---|
| 933,132 | 9/1909 | Smith | 362/287 |
| 1,672,794 | 1/1927 | Tizley . | |
| 1,865,179 | 6/1932 | Egli | 362/410 |
| 1,930,926 | 10/1933 | Doane | 173/324 |
| 2,299,278 | 11/1939 | Paiste | 240/128 |
| 2,595,155 | 4/1952 | Mastrangelo | 439/641 |
| 3,116,027 | 12/1963 | Kleppin | 240/81 |
| 4,493,011 | 1/1985 | Spector | 362/414 |
| 5,091,834 | 2/1992 | Kao et al. | 362/226 |

FOREIGN PATENT DOCUMENTS 154257 7/1932 Switzerland .

OTHER PUBLICATIONS

Popular Mechanics, Apr. 15, 1941.

*Primary Examiner*—Ira S. Lazarus
*Assistant Examiner*—Y. Quach
*Attorney, Agent, or Firm*—Alfred M. Walker

[57] ABSTRACT

A fitting adapter for standing floor lamps which include a C-shaped body having axially positioned threaded members. At the lower end of the C-shaped body there is provided a first female lower threaded member which screws into the the electrical socket of the lamp stand. A male upper threaded member of the lower end of the C-shaped body screws into the finial for holding the lamp shade therebetween. At the upper end of the C-shaped body there is provided a further female threaded portion engagable with a coupling attached to the lamp stand base. With the present invention, a lamp shade for a table lamp can be adapted to fit a standing floor lamp.

1 Claim, 2 Drawing Sheets

LAMP SHADE ADAPTER

FIELD OF THE INVENTION

The present invention relates to a fitting adapter for standing floor lamps, which includes a hollow generally C-shaped pipe body having axially positioned threaded members. One lower end of the adapter has a lower threaded member which screws into the portion of the lamp stand usually suited for an electrical socket, and a further upper threaded member which screws into the a finial for holding the lamp shade therebetween. An upper end of the adapter includes a second further threaded member which screws into a coupling for attaching the adapter to an extension arm of the floor lamp body. Because the C-shaped member is hollow, it retains with the present invention, a lamp shade for a table lamp can be adapted to fit a standing floor lamp, in accordance with the disclosure provided.

BACKGROUND OF THE INVENTION

The prior art generally include brackets for lampshades, but do not include adapters designed for utilizing a conventional table lamp shade with a floor lamp.

U.S. Pat. No. 3,116,027 of Kleppin discloses a display stand, wherein light bulb sockets hang from a horizontal frame cross member.

U.S. Pat. No. 1,672,794 of Tizley discloses an adjustable bracket for lamps with a frictionally movable curved bracket member. See the abstract and drawings.

U.S. Pat. No. 5,091,834 of Kao discloses an electrical coupling plug.

U.S. Pat. No. 2,299,278 of Paiste discloses at FIG. 4 therein a lamp shade and supporting mechanism which includes a curved gooscheck member, disposed to an electrical socket, and a lamp shade frame disposed to a threaded exterior of the socket. However, such an arrangement, which requires that the socket bear a threaded exterior surface, is obsolete, since most electric light sockets are conventionally made without any exterior threading. Moreover, Paiste discloses at FIG. 6 a yoke engageable to a lamp shade by a finial, but the yoke still requires attachment to the socket through the use of exterior threading, in order to use this lamp shade for a suspension lamp or a floor lamp.

U.S. Pat. No. 1,930,926 of Doane describes at FIG. 9 a C-shaped member connected at one end to an engaging member and at another end to a socket. This invention was the C-shaped member to assemble an illustrated smoking stand.

Swiss Patent GE 154257 of Muller discloses armatures for lamp shades, but it does not disclose adaptors for using a table lamp shade with a standing floor lamp.

The Doane, Kao and Paiste patents generally disclose an extension member between a lamp socket and a base or connecting member. Moreover, in Doane and Paiste the extension members are C-shaped.

A significant distinction, however, between the inventions disclosed in Doane, Kao and Paiste and that of the present invention is that the curved C-shaped extension member is C-shaped not for decoration only, but also to accommodate the lamp shade spider arms.

The fitting adapter of the present invention for standing floor lamps includes a C-shaped body having axially positioned threaded members. The lower threaded member screws into the portion of the lamp stand usually suited for an electrical socket. The upper threaded member screws into a finial for holding the lamp shade therebetween. A further threaded element at an upper end of the C-shaped extension is provided for coupling with the upright portion of the standing lamp. With the present invention, a lamp shade for a table lamp can be adapted to fit a standing floor lamp.

OBJECTS OF THE INVENTION

It is an object of the present invention to provide a fitting adapter for standing floor lamps. It is a further object of the present invention to provide an adapter for a lamp shade for a table lamp, which lamp shade can be adapted to fit a standing floor lamp.

It is a further object to provide an adjustable bracket for lamps and a supporting mechanism.

It is a further object to provide a C-shaped member connected at one end to an engaging member and at another end to an electrical light bulb socket.

It is yet another object to provide an adapter for use of table lampshades with floor lampshades, wherein the adapter is not for decoration only, but also to accommodate the lamp shade spider arms.

It is a further object to provide a lamp shade adapter to accommodate electrical wire without twisting the wire.

It is a further object to provide a direct connection of wire from a standing lamp base to a socket.

It is a further object to provide an adapter adaptable for any lamp shade.

It is a further object to overcome the disadvantages of the prior art.

Other objects and advantages will become apparent to one skilled in the art from the drawings and claims herein.

SUMMARY OF THE INVENTION

The present invention relates to a fitting adapter for standing floor lamps, which includes a hollow generally C-shaped pipe body having axially positioned threaded members. One lower end of the adapter has a lower threaded member which screws into the portion of the lamp stand usually suited for an electrical socket, and a further upper threaded member which screws into the a finial for holding the lamp shade therebetween. An upper end of the adapter includes a second further threaded member which screws into a coupling for attaching the adapter to an extension arm of the floor lamp body. Because the C-shaped member is hollow, it retains with the present invention, a lamp shade for a table lamp can be adapted to fit a standing floor lamp, in accordance with the disclosure provided.

The present invention includes a fitting adapter for standing floor lamps which includes a C-shaped hollow body having axially positioned threaded members at both its upper and lower ends. At the lower end, there is provided a lower threaded member which screws into the portion of the lamp stand usually suited for electrical socket. Also provided at the lower end is an upper threaded member screws into the a finial for holding the lamp shade therebetween. At the upper end of the C-shaped hollow body is provided a further threaded member for engagement with a coupling connected to an extension arm of a conventional floor lamp.

DESCRIPTION OF THE DRAWINGS

Other objects and advantages will become apparent from the specification and claims, as described in the drawings, in which:

DETAILED DESCRIPTION

Figure 2:
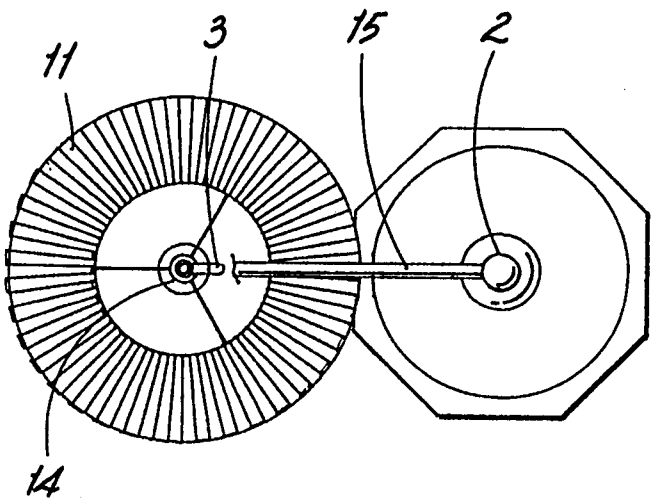
FIG. 2 is a top plan view of the standing floor lamp shade holder as in FIG. 1.

Referring to the drawings in detail, a fitting adapter 1 for standing floor lamps 2 includes a hollow, generally C-shaped, tubular body 3 having axially positioned threaded members 5, 6, 13. At the lower end 4 of the C-shaped body 3, there is provided a lower first female threaded member 5 which engages the portion of a lamp stand usually suited for an electrical socket 7. An upper male threaded member 6 is also located at the lower end 4 of the C-shaped body 3, above the lower first female threaded member 5. This upper male threaded member 6 screws into a finial 9, for securing the spider collar 10 of a lamp shade 11 to the lower end of 4 of the C-shaped body 3.

At the upper end 12 of the C-shaped body 3, there is provided a further female threaded element 13, for engaging a conventional coupling 14 for an extension arm 15 of a floor lamp 2. The hollow C-shaped body 3 will accommodate electrical wire placed through it, without twisting the wire of the lamp 2 or exposing the wire. Thus, the tubular C-shaped body 3 permits the direct connection of the wire from the base of the lamp 2, through the conventional coupling 14 and through the C-shaped body 3, to the socket 7.

A typical example of the above described adapter includes a C-shaped body 3 made of hollow $\frac{1}{8}$ lamp pipe measuring $\frac{3}{8}$ inch in diameter. The threaded female members 5 and 13 generally are "$\frac{1}{8}$" threads, and finial 9 can be a standard "quarter 27" finial. Conventional coupling 14 may be a swivelable coupling.

Figure 1:
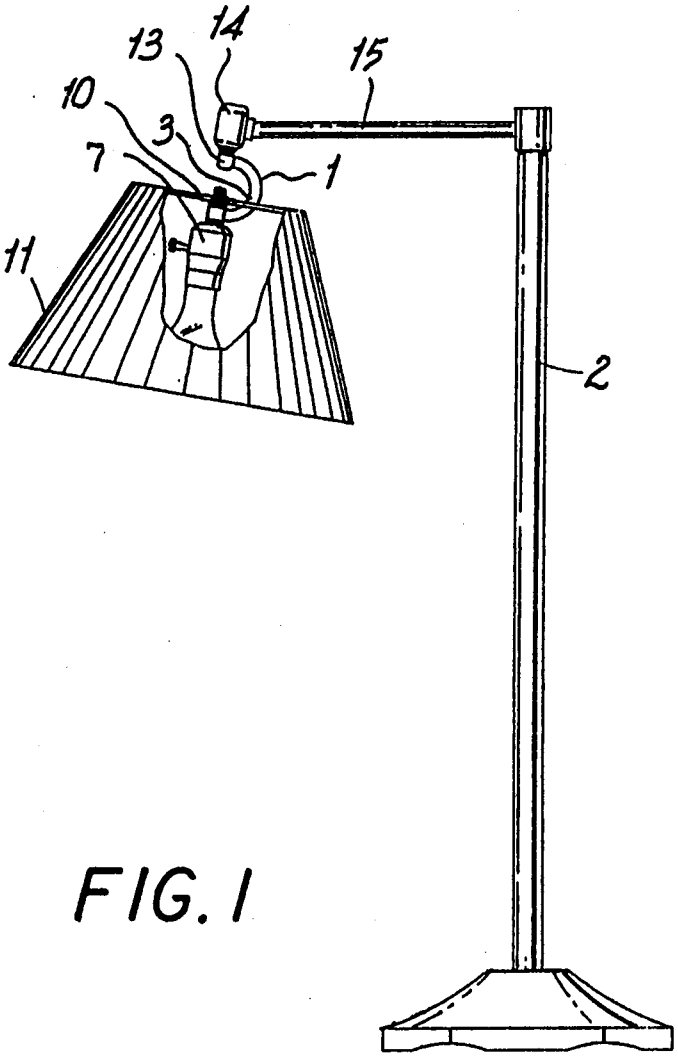
FIG. 1 is a side elevational view of the standing floor lamp shade holder of the present invention, shown in use in place with a standing lamp.
Figure 3:
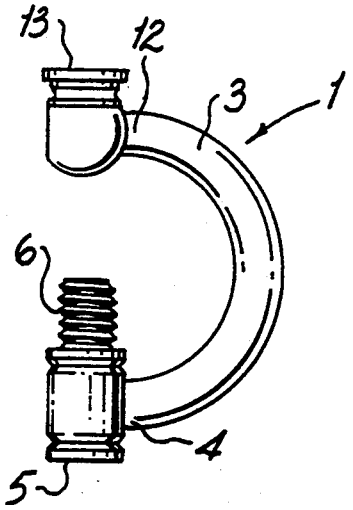
FIG. 3 is a side elevational view of the standing floor lamp shade holder of the present invention.
Figure 4:
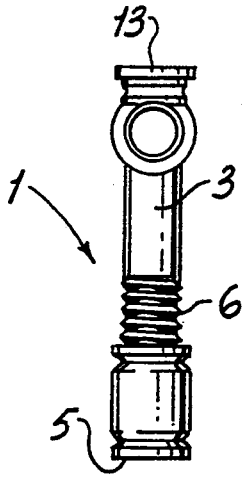
FIG. 4 is a front elevational view of the standing floor lamp shade holder of the present invention, as shown in FIG. 3.
Figure 7:
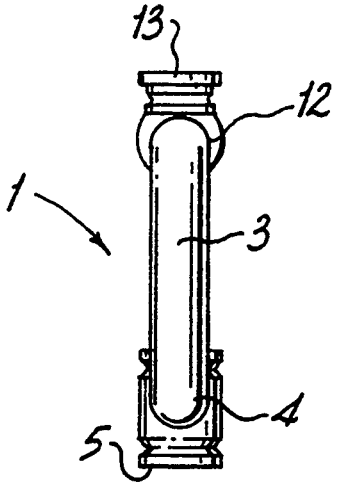
FIG. 7 is a rear elevational view of the standing floor lamp shade holder as in FIG. 3.
Figure 5:
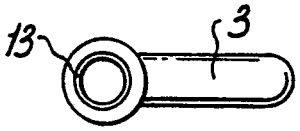
FIG. 5 is a top plan view of the standing floor lamp shade holder of the present invention as in FIG. 3.
Figure 6:
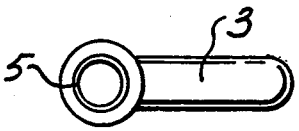
FIG. 6 is a bottom plan view of the standing floor lamp shade holder as in FIG. 3.
Figure 9:
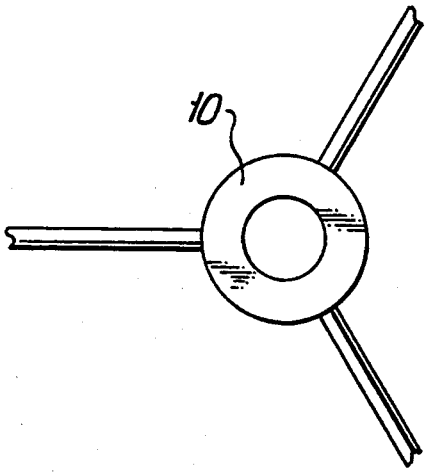
FIG. 9 is a top plan view of a typical prior art lampshade spider.
Figure 8:
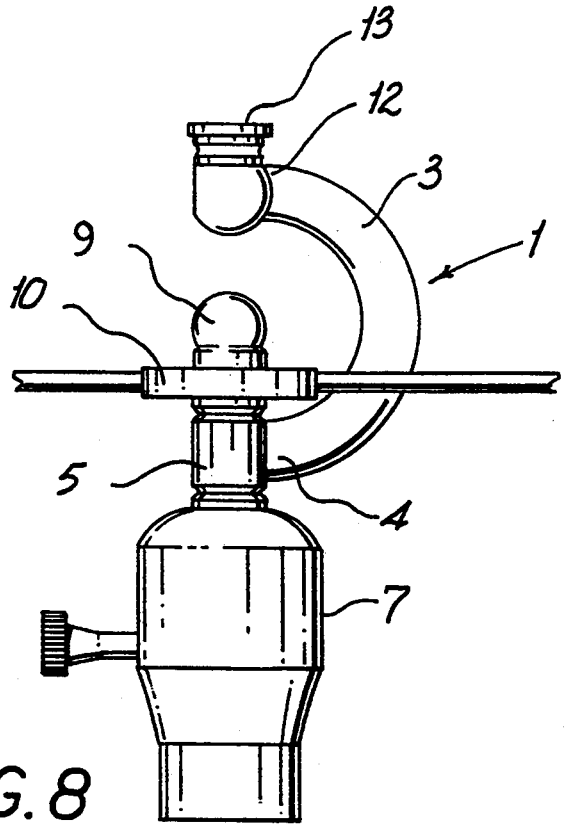
FIG. 8 is a close-up side elevational view of the standing floor lamp shade holder, shown in use with an electrical socket and a lamp shade.

As illustrated in FIGS. 1 and 2, the present invention allows the use of a conventional table lamp shade with a standing floor lamp. The adapter 1 will engage a lamp shade normally designed for a table lamp, by using the finial 9 to secure the spider collar 10 of the lamp shade 11 to the lower end 4 of the C-shaped body 3. This design accommodates the spider arms of the table lamp shade 11. This design also accommodates electrical wire running through the C-shaped body 3, without exposing or twisting the wire. Since this adapter 1 can be attached to the extension arm 15 of a floor lamp 2 and will accommodate the wire of a floor lamp 2, this invention permits the covenient adapting of a table lamp shade to fit a standing floor lamp.

Although a single embodiment has been shown, various modifications may be made to the present invention without departing from the spirit and scope of the appended claims.

I claim:

1. A fitting adapter for standing floor lamps comprising a hollow, generally C-shaped, tubular body, said tubular body having axially positioned threaded members, said C-shaped tubular body having an upper end and a lower end, said lower end having a first female threaded member engagable with an electrical socket for a light bulb, said lower end further having a first male threaded member, said first male threaded member positionable at said lower end of said C-shaped tubular body above said first female threaded member; said male threaded member threadable into a finial, for securing a spider collar of a lamp shade to said lower end of said C-shaped tubular body; a further female threaded member provided at said upper end of said C-shaped tubular body for engaging a conventional coupling of an extension arm of a floor lamp; said hollow C-shaped tubular body accommodating electrical wire therethrough, said C-shaped tubular body permitting a direct connection of said electrical wire from said floor lamp through said coupling and through said C-shaped tubular body to the electrical socket.

* * * * *